US006570958B2

(12) United States Patent
Brendler

(10) Patent No.: US 6,570,958 B2
(45) Date of Patent: May 27, 2003

(54) X-RAY SYSTEM FOR FORMING X-RAY IMAGES

(75) Inventor: Joachim Brendler, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/198,613

(22) Filed: Jul. 18, 2002

(65) Prior Publication Data

US 2003/0021380 A1 Jan. 30, 2003

(30) Foreign Application Priority Data

Jul. 28, 2001 (DE) ..... 101 36 947

(51) Int. Cl.[7] ..... H05G 1/10
(52) U.S. Cl. ..... 378/113; 378/138
(58) Field of Search ..... 378/113, 138

(56) References Cited

U.S. PATENT DOCUMENTS 4,366,395 A 12/1982 Gillard et al.

FOREIGN PATENT DOCUMENTS

| | | |
|---|---|---|
| JP | 11-204289 | 7/1999 |
| WO | WO00/52972 | 8/2000 |

*Primary Examiner*—Craig E. Church
(74) *Attorney, Agent, or Firm*—Eugene E. Clair

(57) ABSTRACT

The invention relates to an X-ray system/generator in which after the end of an X-ray exposure the grid of th X-ray tube is blocke4d as long as the X-ray exposure is read out from a detector (or as long a film or a PCR is removed from the X-rays). After read out, the grid is released so that the system capacitance may be discharged via the X-ray tube.

Thereby over-exposure due to energy stored in the sytem-and cable capacities is avoided (which is a problem especially for thin objects), and the system may be switched from a tube with grid to a tube without grid without problems.

5 Claims, 2 Drawing Sheets

X-RAY SYSTEM FOR FORMING X-RAY IMAGES

BACKGROUND

The invention relates to an X-ray system which includes at least one X-ray source which is provided with a control grid and serves to form X-ray images, at least one X-ray image converter which is provided with means for electronically reading out X-ray images, and an X-ray generator for power supply of the X-ray source. The invention also relates to an X-ray generator suitable for an X-ray system of this kind.

When X-ray images are formed, energy is still stored in the capacitances of the system at the end of an X-ray exposure. These capacitances include the capacitances of the cable or cables via which the X-ray source is connected to a high-voltage generator and also the capacitors of a DC/AC converter which is included in the X-ray generator. Because of the stored energy, at the end of the exposure the high voltage on the X-ray source can decrease at the end of the exposure only to the extent to which the capacitances are discharged, that is, mainly via the X-ray source. The discharging of the capacitances via the X-ray source will take more time as the current through the X-ray source during the exposure is smaller. Therefore, the X-ray source continues to emit radiation after the end of the actual exposure; such radiation may give rise to undesirable overexposures.

This problem is serious notably when thin objects are imaged, for example, in pediatrics, because the small thickness of the object and a specified value of the high voltage (for example, 70 kV) permit the switching of only a very small mAs value (approximately 0.05 mAs). Because of the energy stored in the capacitances, however, X-ray sources (without control grid) only allow the switching of mAs values which are a number of times higher than the desired mAs value. These values allow overexposure of an X-ray image to be avoided only if, contrary to, for example, the IEC regulations, the exposure takes place while using a lower voltage across the X-ray tube. However, when the voltage across the X-ray tube is lower, the radiation load for the patient will be higher.

This dilemma is avoided in an X-ray generator which is known from Japanese patent application 11-204289 and is provided with a high-voltage generator, whereto the X-ray source is connected, and also with means for switching the high voltage of the high-voltage generator on and off and with a grid control circuit for controlling the grid. This X-ray generator serves to generate stable X-ray pulses without overshoot with the aid of the control grid. Additionally, at the end of the exposure the current through the X-ray source is switched off by means of the control grid, so that the energy stored in the system cannot give rise to overexposure.

Problems are encountered, however, when an X-ray generator of this known kind has to feed not only the X-ray source provided with a control grid, but also one or more X-ray sources without a control grid. X-ray sources of that kind are used for economical reasons in the case of high exposure powers for which the described problem is not so serious. The problem consists in that the stored energy, or the high voltage across the X-ray source, can decrease only very slowly because the control grid blocks the current flow through the X-ray source after the end of the exposure. When the X-ray generator is switched over to a different X-ray source (of a different apparatus) in this phase, such switching over takes place at a high voltage for which the conventional high voltage switches are not designed. Moreover, it is undesirable that the new X-ray source emits X-rays already at the beginning of the preparation phase which precedes an X-ray exposure and in which, for example, the rotary anode is accelerated to the correct speed and the filament of the cathode of this X-ray source is heated.

The latter problem is also encountered in X-ray tubes which are provided with two cathodes for two focal spots of different size; in that case the electron current to one focal spot (usually the smaller one) can be blocked by means of a control grid and no grid control is available for the other focal spot. In the case of examination of one and the same object, an automatic change-over from one focal spot to the other and vice versa may occur during a series of exposures, thus giving rise to premature emission of X-rays.

SUMMARY OF THE INVENTION

It is an object of the invention to provide an X-ray system or an X-ray generator which on the one hand enable accurate exposure of the X-ray image and in which on the other hand the problems involved in the fast change-over from X-ray exposures with grid control to X-ray exposures without grid control are avoided at least to a high degree.

The object in accordance with the invention is achieved by means of an X-ray system which includes at least one X-ray source which is provided with a control grid and serves to form X-ray images, and also includes at least one X-ray image converter which is provided with means for electronically reading out X-ray images or for transporting the X-ray image converter out of the zone covered by the X-ray source in a time interval which succeeds the X-ray exposure, and also an X-ray generator for power supply of the X-ray source, which X-ray generator includes:

- a high-voltage generator whereto the X-ray source can be connected,
- means for switching the high voltage of the high-voltage generator on and off at the beginning and the end of an X-ray exposure, and
- a grid control circuit for blocking the control grid and the current through the X-ray source during the time interval and for subsequently enabling the current to flow through the X-ray source.

In accordance with the invention, the control grid, or the current through the X-ray source, is blocked in the time interval after the end of the exposure in which the X-ray exposure is read out (in the case of an X-ray image converter which is suitable for electronic reading out) or in which the X-ray image converter is moved out of the beam path (in the case of an X-ray image converter in the form of a film-foil combination or a storage phosphor). Consequently, in this time interval the X-rays are interrupted so that further exposure of the X-ray image converter (or overexposure) no longer takes place. Because of the blocking of the X-ray source, the high voltage across the X-ray source decreases only very slowly during this time interval.

When the current through the X-ray source is enabled again after the time interval, X-rays are produced again, but such X-rays are not of importance to the previous X-ray exposure (already electronically read out or transported out of the beam path together with the X-ray image converter). However, the capacitances of the system can then also be discharged via the X-ray source, so that the voltage across the X-ray source decreases substantially faster than during the interruption of the current by means of the control grid. Consequently, problems are no longer encountered when briefly thereafter switching over takes place from one X-ray source or one focal spot to another X-ray source or focal spot.

An X-ray generator for power supply of at least one X-ray source which is provided with a control grid in order to form X-ray images for an X-ray system as described above including a high-voltage generator whereto the X-ray source is connected and means for switching the high voltage of the high-voltage generator on and off at the beginning and the end of an X-ray exposure. A grid control circuit is provided for blocking the control grid and the current through the X-ray source during a short time interval ($T_2$–$T_3$) and for subsequently enabling the current to flow through the X-ray source.

The following description, claims and accompanying drawings set forth certain illustrative embodiments applying various principles of the present invention. It is to be appreciated that different embodiments applying principles of the invention may take form in various components, steps and arrangements of components and steps. These described embodiments being indicative of but a few of the various ways in which some or all of the principles of the invention may be employed in a method or apparatus. The drawings are only for the purpose of illustrating an embodiment of an apparatus and method applying principles of the present invention and are not to be construed as limiting the present invention.

BRIEF DESCRIPTION OF THE DRAWINGS

The foregoing and other features and advantages of the present invention will become apparent to those skilled in the art to which the present invention relates upon consideration of the following detailed description of apparatus applying aspects of the present invention with reference to the accompanying drawings, wherein.

DETAILED DESCRIPTION

Figure 1:
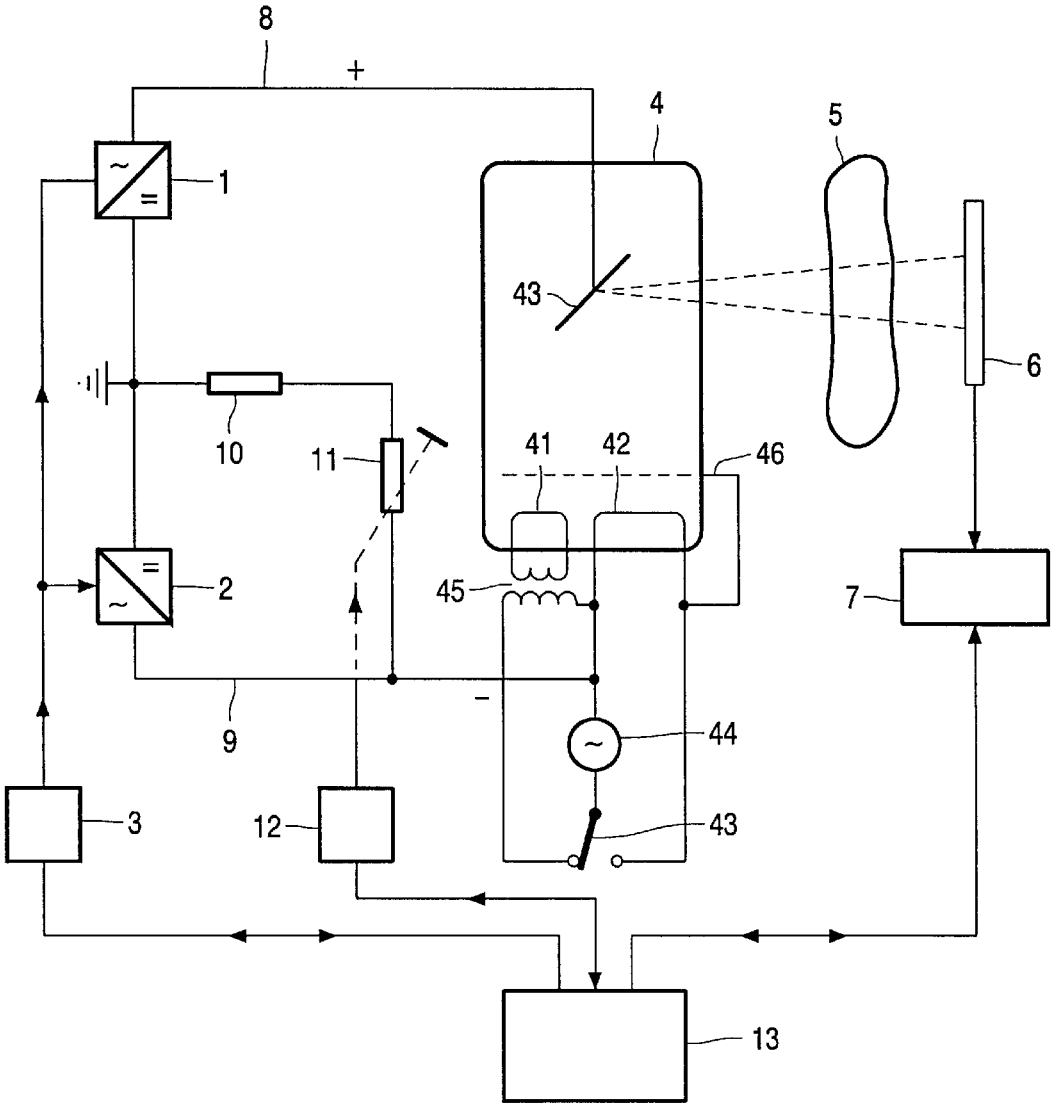
FIG. 1 shows an X-ray system which includes an X-ray generator in which the invention can be implemented.

FIG. 1 shows two converter generators 1 and 2 which are connected in series (with a grounded connection point) and customarily comprise the following components (not shown in the drawings): a rectifier for generating a DC voltage from a mains voltage, a DC/AC converter for generating an AC voltage which has a frequency in the kHz range and an adjustable amplitude, and a high-voltage generator with a high voltage transformer for generating a high voltage and a rectifier for rectifying the high voltage. The converter generators 1 and 2 thus deliver adjustable DC voltages of up to ±75 kV on their outputs. The voltages delivered by the converter generators 1 and 2 can be adjusted in respect of amplitude and switched on and off by means of a control circuit 3.

The output voltages of the converter generators 1 and 2 are applied to an X-ray source 4 via two high voltage cables 8, 9. The X-ray source is provided with a first electrode emitter 41 at the cathode side, which emitter is capable of delivering a comparatively small electron current which is incident on a comparatively small focal spot on the oppositely situated anode 43, and also with a second, significantly larger electron emitter 42 which is capable of emitting a significantly larger electron current which is incident on a significantly larger focal spot on the anode 43. During the examination of a patient who is positioned in the beam path, both electron emitters can be successively activated (preferably automatically) in dependence on the degree of absorption of the X-rays by the relevant object 5 in the beam path.

The two electron emitters 41 and 42 may be formed by filament coils having external dimensions which are suitable for the relevant focal spot. Each time one of the two electron emitters can be connected to a filament current source 44 via a switch 43. However, whereas the filament 42 is connected directly to the combination 43, 44, the filament 41 for the smaller focus is connected to this combination via a transformer 45.

A control grid 46 is provided for switching the electron current of the electron emitter 41 on and off. The control grid is formed by an electrode whose potential can be changed relative to the potential of the filament 41. This control grid can be manufactured particularly easily when use is made of the cathode head which is already required for the formation of the electron paths emanating from the electron emitters and is provided with a respective aperture for the two electron emitters. Because the aperture for the larger electron emitter 42 is larger, the electron current emitted thereby could not be blocked by means of a comparatively small voltage (a few kV) between the grid 46 and the electron emitter 42. The electron emitter 42 and the electrode 46, therefore, are electrically interconnected and carry the same potential which is defined by the negative output voltage of the converter generator 2 and applied to the electron emitter 42 via the high voltage cable 9.

However, the electron current emitted by the electron emitter 41 can be interrupted when the potential across the control grid 46 is a few kV more negative than that on the electron emitter 41. To this end, there is provided a voltage divider which receives the output voltage of the converter generator 2 for the negative high voltage and includes a fixed resistor 10 and an electronically variable resistor 11. One terminal of the resistor 11 is conductively connected, via the transformer 11, to the electron emitter 41 and its other terminal is connected to the high voltage output of the converter generator 2 and hence conductively to the control grid 46. The voltage drop across the resistor 11, therefore, determines the magnitude of the bias voltage between the grid 46 and the electron emitter 41.

The electronically variable resistor 11 (whose construction is not shown) may include, for example, series-connected transistors whose conductivity can be switched from a first state to a second state by a grid control circuit 12. In the first state the resistor 11 has a very high conductivity so that practically the entire voltage drops off across the resistor 10 and the electron emitter 41 carries substantially the same potential as the grid 46. In this state the electrons emitted by the electron emitter 41 can reach the anode 43 completely. In the second state the conductivity of the variable resistor 11 is less, so that a voltage drop of a few kV occurs across this resistor. The potential on the grid 46 is then more negative, in proportion to this voltage drop, than the potential on the electron emitter 41, so that the electron current from the electron emitter 41 to the anode 43 is blocked.

The X-rays generated by the X-ray source traverse the object 5 to be examined and are detected by an X-ray image converter which can be electronically read out. The X-ray image converter may include, for example, a plurality of, for example, 2000×2000 light-sensitive elements which are arranged in the form of a matrix and positioned behind a fluorescent layer which converts the X-rays into visible light. However, any other electronically readable X-ray image converter may also be used, for example, an X-ray image intensifier whose output image is converted into electric signals by a CCD camera. After the reading out, an image processing device 7 coupled to the X-ray image converter 6 will contain a digital image and the X-ray image converter can be exposed again. The image processing device 7, the grid control circuit 12 and the circuit 3 for switching the converter generators 1, 2 on and off are controlled by a control unit 13.

Figure 2:
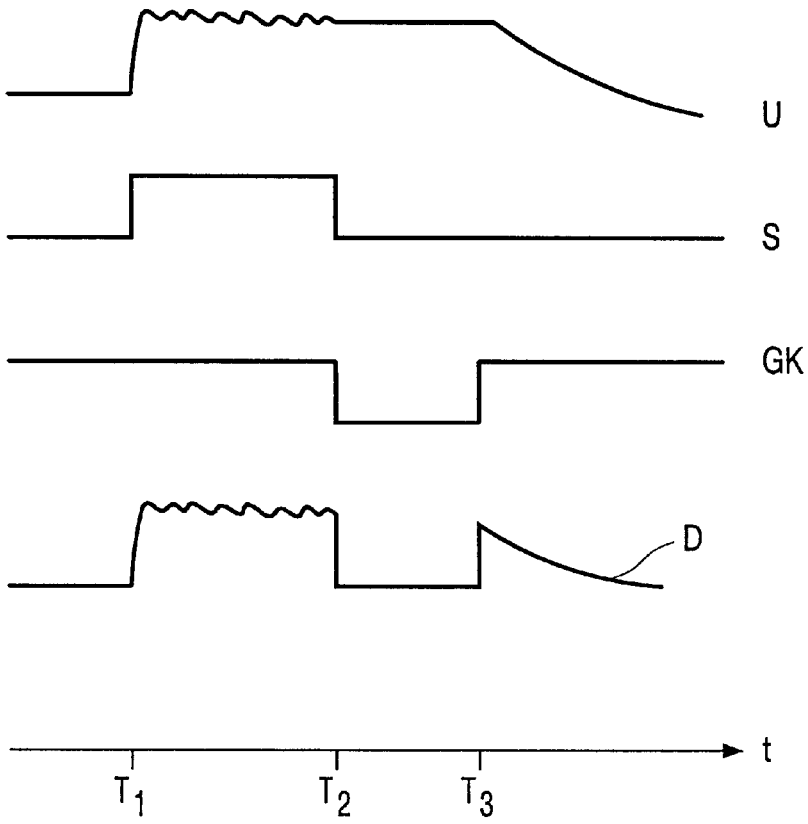
FIG. 2 illustrates the variation in time of various electrical quantities in an X-ray generator of this kind.

The execution in time of an X-ray exposure will be described in detail hereinafter with reference to FIG. 2 which shows the variation in time of various electrical quantities in the X-ray system shown in FIG. 1. The first line shows the variation in time of the high voltage U across the X-ray source 4. The second line shows the variation in time of the output signal S of the circuit 3 whereby the high voltage is switched on and off. The third line shows the variation in time of the voltage between the grid and the cathode, and the fourth line shows the variation in time of the dose rate D produced by the X-ray source 4.

Prior to the instant $T_1$, that is, before the high voltage is switched on by the signal S, no voltage U is present across the X-ray source and the voltage between the grid and the cathode is also zero. No X-rays are then generated. In this (preparatory) phase, however, the filament current source 44 already heats the electron emitter 41 and the anode 43 of the X-ray source 4, being constructed as a rotary anode, is accelerated to its operating speed, so that at the end of this preparatory phase the full number of revolutions of the anode is reached and the electron emitter has reached a given temperature. At the instant $T_1$ the switching signal S activates the converter generators 1 and 2 so that the voltage U across the X-ray source increases until it reaches a stationary value. The voltage between the grid and the cathode retains its previous value, so that the electron current can reach the anode without obstruction and X-rays are generated.

The X-ray exposure is terminated at the instant $T_2$. This end of the exposure can be initiated by a timer or an automatic X-ray exposure device when the dose behind the output 5 reaches a given value. At that instant the conductivity of the variable resistor 11 is abruptly reduced, so that the voltage between the grid and the cathode becomes negative and the electron current through the X-ray tube 4 is blocked or interrupted; therefore, the X-ray image converter is no longer exposed. At the same time the generating of the high voltage by the converter generators 1 and 2 is stopped. However, in this phase the voltage U across the X-ray source decreases only very slowly because of the energy stored in the cable capacitances and in other capacitances of the system.

The reading out of the X-ray image converter also commences at the instant $T_2$ and terminates at the instant $T_3$ (for example, 200 ms after the instant $T_2$).The current through the X-ray source, and hence the X-rays, must be interrupted during the reading out.

At the end of the read-out operation, that is, at the instant $T_3$ (or briefly thereafter), the voltage between the grid and the cathode resumes its original value. X-rays can thus be produced again, however, without it being possible for these X-rays to give rise to an overexposure because the X-ray image converter has already been read out. The current which arises again through the X-ray source as from the instant $T_3$ ensures that the cable capacitances and the other capacitances of the system in which energy is stored can be discharged significantly faster than previously in the period $T_2$–$T_3$. Consequently, the voltage U across the X-ray source also decreases faster than before and comparatively quickly reaches a value which is so low that it no longer has a disturbing effect.

If the switch 43 were then switched over, so that the filament current source 44 would heat the electron emitter 42, a tube current would arise only after renewed activation of the converter generators 1 and 2. This electron emitter would produce a significantly larger electron current than the electron emitter 42. At the end of the exposure this electron current could not be interrupted. However, it would very quickly discharge the cable capacitances and the other capacitance of the system, so that the mAs product still active after the end of the exposure would be rather small in comparison with the mAs product active during the exposure, so that it could practically not lead to an overexposure.

The invention is of course not limited to the described or shown embodiments, but generally extends to any embodiment, which falls within the scope of the appended claims as seen in light of the foregoing description and drawings. While a particular feature of the invention may have been described above with respect to only one of the illustrated embodiments, such features may be combined with one or more other features of other embodiments, as may be desired and advantageous for any given particular application. From the above description of the invention, those skilled in the art will perceive improvements, changes and modification. Such improvements, changes and modification within the skill of the art are intended to be covered by the appended claims. For example, the invention has been described in conjunction with an X-ray image converter which can be read out electronically. The invention, however, can also be used for X-ray image converters which are automatically transported out of the beam path, for example, by means of a carriage. In that case, for example, a film-foil combination may be concerned, said combination being displaced to a parking position after the exposure, or a storage phosphor may be concerned which is transported to a reading station in which the X-ray image is read out by means of a laser. In the case of highly sensitive image converters of this kind, or in the case of exposure of thin objects, the previously described problem of overexposure also occurs. This problem is eliminated in that the control grid remains blocked in the time interval after the X-ray exposure in which the X-ray image converter is moved out of the beam path.

Having described a preferred embodiment of the invention, the following is claimed:

1. An X-ray system comprising;

at least one X-ray source to form X-ray images during an x-ray exposure time interval;

a control grid operatively connected to control the x-ray source;

at least one X-ray image converter for electronically reading out X-ray images in a time interval ($T_2$–$T_3$) which succeeds the X-ray exposure time interval ($T_1$–$T_2$); and an X-ray generator for power supply of the X-ray source, the X-ray generator comprising:

a high-voltage generator connected to the X-ray source;

means for switching the high voltage of the high-voltage generator on and off at the beginning and at the end of the X-ray exposure time interval; and a grid control circuit for blocking the current through the X-ray source during the time interval ($T_2$–$T_3$)

and for subsequently enabling the current to flow through the X-ray source.

2. The x-ray system of claim 1 wherein one of the at least one x-ray sources includes at least two cathode filaments and at least one of the cathode filaments is controlled by the control grid.

3. The x-ray system of claim 1 includes two x-ray tube assemblies and one of the x-ray tube assemblies includes the control grid.

4. The x-ray system of claim 1 wherein a bracket for supporting the x-ray converter is adapted for transporting the X-ray image converter out of the zone covered by the X-ray source within the time interval ($T_2$–$T_3$).

5. An X-ray generator for power supply of at least one X-ray source provided with a control grid, the x-ray generator comprising:

a high-voltage generator connected to the X-ray source;

means for switching the high voltage of the high-voltage generator on and off at the beginning and at the end of an X-ray exposure time interval ($T_1$–$T_2$); and a grid control circuit for blocking the current through the X-ray source during a time interval ($T_2$–$T_3$) and for subsequently enabling the current to flow through the X-ray source.

* * * * *